US006986637B2

(12) United States Patent
Coxhead

(10) Patent No.: US 6,986,637 B2
(45) Date of Patent: Jan. 17, 2006

(54) STUB AXLE

(75) Inventor: Todd M Coxhead, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 10/839,251

(22) Filed: May 6, 2004

(65) Prior Publication Data

US 2005/0152776 A1 Jul. 14, 2005

(30) Foreign Application Priority Data

May 22, 2003 (GB) ..... 0311737

(51) Int. Cl.
*F01D 21/00* (2006.01)

(52) U.S. Cl. ..... 415/9; 415/216.1; 416/2; 416/144; 60/39.091

(58) Field of Classification Search ..... 416/2, 416/144, 244 A; 415/9, 216.1; 60/39.091, 60/223; 464/180; 74/572.1, 572.11, 572.2, 74/572.21

See application file for complete search history.

(56) References Cited

U.S. PATENT DOCUMENTS 4,455,887 A * 6/1984 Lissajoux et al. ..... 464/180
4,475,869 A * 10/1984 Davies ..... 416/2
5,205,189 A 4/1993 Wesling
6,240,719 B1 6/2001 Vondrell

FOREIGN PATENT DOCUMENTS

GB 2111639 A 7/1983

* cited by examiner

*Primary Examiner*—Christopher Verdier
(74) *Attorney, Agent, or Firm*—W. Warren Taltavull; Manelli Denison & Selter PLLC

(57) ABSTRACT

A stub shaft for a turbine engine is described in which respective masses are positioned along the stub shaft in a balanced rotation relationship for normal rotation. One mass is positioned at the periphery of a shaft end rim such that upon failure of the stub shaft this mass is detached. Such displacement or detachment of the mass causes imbalance which creates vibration which in turn causes surge within a compressor associated with the stub shaft as well as possibly interference engagement with stable structure elements in order to limit turbine and/or compressor over speed.

10 Claims, 2 Drawing Sheets

STUB AXLE

The present invention relates to stub axles and more particularly to stub axles used with regard to intermediate pressure compressors of a turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produces two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts.

It will be noted that the intermediate pressure compressor 13 is located upon a stub shaft 1. The stub shaft 1 is generally, or at least possibly, upstream of the intermediate pressure compressor location bearings. If this stub shaft fails in use, it will be understood that the torque load of the intermediate compressor on the turbine is lost and therefore the turbine may over speed. Failure of the intermediate shaft 1 rearwards of any axial supports such as a location bearing allows the turbine 17 to move axially rearwards towards the stator 2. Such action would cause interference braking between the turbine and the stator and therefore limit over speed. However, failure of sections of the shaft 1 forwards of any axial support may not allow the turbine to move rearwardly into interference engagement with the stators and therefore prevent a brake limiter to over speed. In such circumstances, failure of the intermediate compressor stub shaft 1 in a section forward of any location bearing can present and cause a hazardous condition for the turbine 17.

In accordance with the present invention there is provided a stub shaft for a turbine engine, the shaft comprising a shaft end associated with a compressor, the shaft characterised in that a failure mass is secured upon the shaft end and an intermediate mass secured at an intermediate location on the shaft, and a mass providing rotational balance for the shaft in normal use whereby upon failure of the shaft the failure mass is displaced and the shaft vibrates to cause compressor surge.

Typically, the shaft end is forwards of an axial mounting for the stub shaft.

Generally, vibration causes radial displacement of the stub shaft whereby there is interference engagement with stable structures such as stators to drag brake the shaft and limit rotational speed.

Generally, the shaft end is bell shaped. Furthermore, the failure mass is secured at a rim of that bell shape. Further advantageously, the intermediate mass is secured at a crown part of the bell shaped end.

Normally, the balance mass is placed along the stub axle to balance couple between the failure mass and the intermediate mass for rotational balance of the stub shaft in normal use.

Possibly, one or more of the masses is moveable to achieve tuning of rotational balance for the stub shaft.

Also in accordance with the present invention there is provided a turbine engine incorporating a stub shaft as described above.

An embodiment of the present invention will now be described by way of example only with reference to the accompanying drawings in which.

In the event of an intermediate pressure shaft failure of a gas turbine the torque load applied to the intermediate pressure compressor is lost. Thus, for a short period of time the turbine has a significant pressure reduction across it which in turn leads to rotational acceleration. This acceleration will lead to an over speed condition where the forces applied to the turbine are too high and the turbine will therefore itself fail. More importantly, with such high levels of kinetic energy containment of the failing fragments of the turbine is unlikely and so there may be hazardous consequences.

Generally, as indicated above, if the intermediate pressure shaft fails rearwards of its axial supports (such as locational bearings) then the shaft will tend to move axially rearwards towards stationary structures such as stators whereupon interference friction will occur which although causing damage to the turbine blades will prevent occurrence of over speed. However, failure of sections of the shaft forwards of such axial support does not allow or cause turbine movement axially with resultant interference with stable structures in order to prevent over speed. Generally, the intermediate compressor stub shaft is a section of the intermediate pressure shaft located forwards of the location bearings. Generally, interference slowing of the stub shaft is only really beneficial when the interference is "downstream" of the failure or break.

In accordance with the present invention upon intermediate pressure compressor stub shaft failure the compressor is arranged to surge without recovery. This surge reduces the pressure gradient across the turbine and so inhibits the accelerating force causing over speed rotation of the turbine. Such surging occurs due to the detrimental effect of vibration on the blade aerodynamics especially tip clearance.

Figure 1:
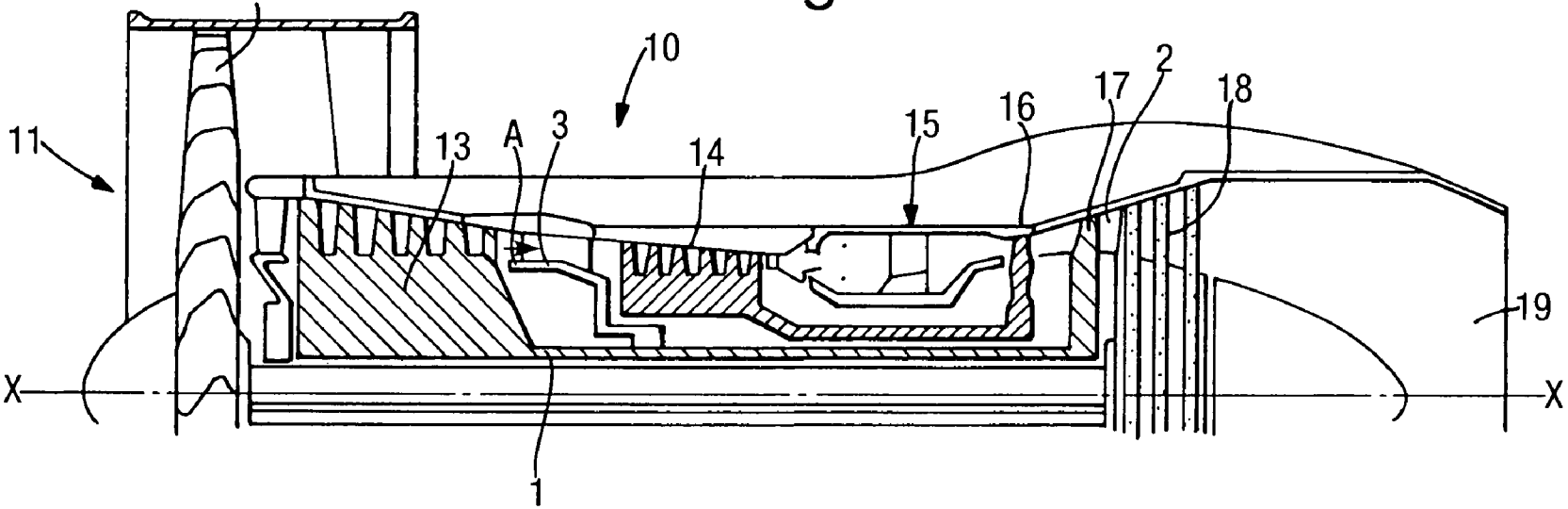
FIG. 1 is a schematic cross section of a typical turbine engine.

As indicated previously, FIG. 1 is a schematic cross section of a gas turbine engine. As can be seen, the intermediate pressure compressor 13 is secured upon a stub shaft 1. The stub shaft 1 generally takes a bell shaped drum cross-section at a shaft end 3 associated with the intermediate pressure compressor 13. The shaft 1 connects the intermediate pressure compressor 13 with the intermediate pressure turbine 17 with an intermediate pressure flow passing in the direction of arrowhead A to the high pressure compressor 14.

Figure 2:
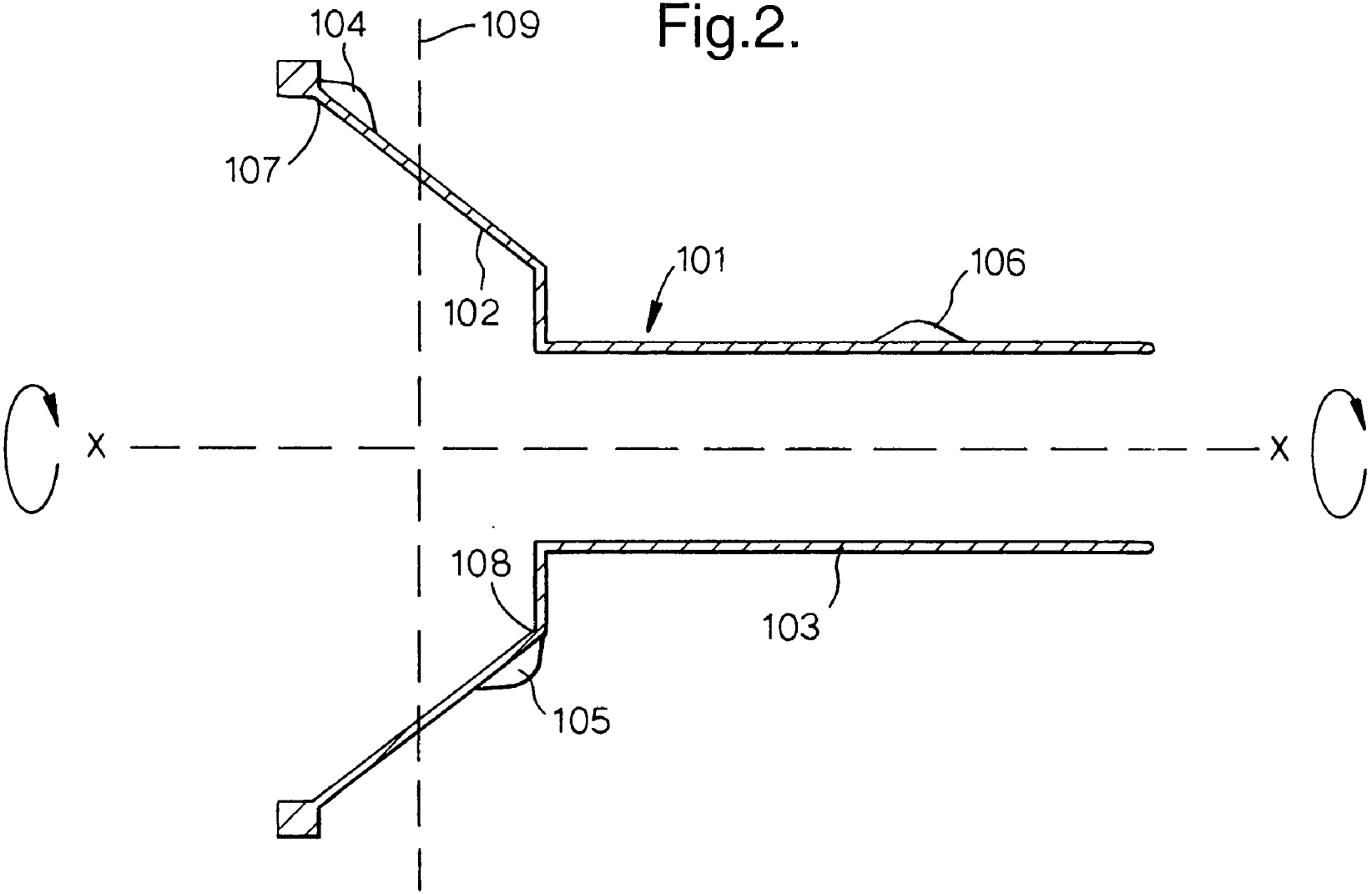
FIG. 2 is a schematic cross-section of a stub shaft in accordance with the present invention.

FIG. 2 is a schematic cross-section of a stub shaft 101 in accordance with the present invention. As can be seen, the stub shaft 101 incorporates a shaft end in the form of a bell shaped drum 102. This bell shaped drum 102 is associated with the intermediate pressure compressor or turbine (13 or 17 in FIG. 1) with a stub axle 103 extending away from the bell shaped drum 102 in order to provide the stub shaft. This stub axle 103 rotates about a centre line X—X and typically as indicated previously is coupled to the intermediate pressure turbine (17 in FIG. 1).

In accordance with the present invention a number of mass elements 104, 105, 106 are located about the stub shaft 101. A failure mass 104 is secured about a peripheral edge or rim of the bell shaped drum shaft end 102. An intermediate mass 105 is located at an intermediate position within the stub shaft 101. A balance mass 106 is located at a position along the length of the stub axle 103. All the masses 104, 105, 106 are held in a rotational balance. Thus, the balance mass 106 essentially equalises the mass couple created between the failure mass 104 and intermediate mass 105.

It is necessary that the masses 104, 105, 106 are balanced. Typically, a normal balanced relationship is when the failure mass 104 is placed at a top dead centre position near a rim 107 of the shaft end 102 whilst the intermediate mass 105 is placed at a bottom dead centre position near to a crown edge 108 of the shaft 101 whilst as a result of their relatively different displaced positions both longitudinally and radially relative to the centre of rotation (line X—X) it is necessary to provide the balance mass 106 at an appropriate position along the axle 103. Typically, the intermediate mass 105 is positioned at a position at which location bearings for the stub shaft 101 are located in use. Thus, with all the masses 104, 105, 106 in position there is a substantially neutral couple effect to enable smooth and balanced rotation of the shaft 101 in use. The balance mass 106 is generally placed at a top dead centre position as indicated above at a position along the axle 103 in order to create this balanced couple effect between the masses 104, 105, 106. Failure of the shaft between these masses 104, 105, 106 will cause vibration.

As indicated above, failure of the stub shaft 101 will result in displacement of the failure mass 104. This displacement will result in the intermediate pressure compressor and the masses 104 or 105 becoming detached from the stub shaft 101. In such circumstances, the masses 104, 105, 106 are now unbalanced and rotation of the shaft 102 causes vibration. In short, the bell shape drum 102 is out of balance with the masses 104, 105 on one side. This vibration will cause compressor surging.

In order to ensure sufficient severity of vibration the out of balance couple between the masses 104, 105 should be large. As indicated previously, it is by the vibrations that the compressor surges and an intermediate pressure turbine over speed is prevented.

In order to reduce the bending effects presented to the stub shaft 101 by the relative locations of the masses 104, 105, 106 it will be understood that the angles between the respective masses 104, 105, 106 may be changed in particular embodiments provided that rotational and longitudinal balance is maintained in normal operation of the shaft 101. Alternatively, bending effects may be avoided by increasing shaft 101, 102 strength.

The masses 104, 105, 106 will typically be formed from a relatively high density material which has sufficient physical characteristics to withstand heat and centrifugal forces presented during operation of a turbine engine. The masses 104, 105, 106 will be secured at their relative locations by appropriate means including adhesive, brazing and other finishing techniques including use of bolts and rivets. Generally, as shown, the masses 104, 105, 106 will be secured upon outer surfaces of the stub shaft 101. Although shown as single elements, the masses 104, 105, 106 may be formed by a plurality of elements appropriately secured and located about the stub shaft 101 in order to achieve their functional necessities in terms of a displaceable failure mass, a intermediate mass and a balance mass for normal operation.

It will be appreciated that the particular mass of each mass 104, 105, 106 will be dependent upon stub shaft 101 and end 102 mass and balanced mass locations as well as the necessity to achieve rotational balance in normal operation and sufficient vibration for over speed control in accordance with the present invention upon displacement of the balance masses, 104, 105, 106 relative to each other.

The balance mass 106 as well as the intermediate mass 105 may be arranged when there is failure of the stub shaft 101 resulting in displacement of the failure mass 104, to provide an interference friction contact in order to slow rotation of the shaft 101. Similarly, the balance mass 106 may become slightly displaceable upon vibration as a result of the unbalanced state when the failure mass 104 is displaced whereby that balance mass 106 comes into interference contact with a stable structure in order to provide braking of IP turbine (17 in FIG. 1) rotation. Generally, as indicated above the most hazardous situation with regard to stub shaft 101 failure are those where the failure is forward of the location bearings for the shaft 101. In FIG. 2 broken line 109 shows such a position. In this situation as described previously, the failure mass 104 is detached from the intermediate mass 105 and balance mass 106. Thus, the portion of the bell shape drum 102 detached with the mass 104 causes that portion to be out of balance. If this failure mass 104 is of sufficient magnitude there are enough vibrations in the compressor associated with that portion of the drum 102 whereby the compressor surges which in turn reduces the pressure across the turbine associated with the stub shaft with the result that a turbine over speed conditions is prevented.

It is imbalance between the masses 104, 105, 106 which creates vibration so that these functions within the present stub shaft arrangement may be interchangeable.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A stub shaft for a turbine engine, the shaft comprising a shaft end associated with a compressor, the shaft characterised in that a failure mass is secured upon the shaft end and an intermediate mass secured at an intermediate location on the shaft and a balance mass providing rotational balance for the shaft in normal use whereby upon failure of the shaft the failure mass is displaced and the shaft vibrates to cause compressor surge.

2. A stub shaft as claimed in claim 1 wherein the shaft end is forward of a mounting for the stub shaft.

3. A stub shaft as claimed in claim 1 wherein the vibration causes radial displacement of the stub shaft whereby there is interference engagement with stable structures to drag brake the shaft and limit rotational speed of the turbine or compressor.

4. A stub shaft as claimed in claim 1 wherein the shaft end is bell shaped.

5. A stub shaft as claimed in claim 4 wherein the failure mass is secured at a rim of the bell shape.

6. A stub shaft as claimed in claim 4 wherein the intermediate mass is secured at a crown part of the bell shape.

7. A stub shaft as claimed in claim 1 wherein the balance mass is placed along a stub axle of the shaft to balance couple between the failure mass and the intermediate mass for rotational balance of the stub shaft in normal use.

8. A stub shaft as claimed in claim 1 wherein one or more of the masses is moveable to achieve tuning of rotational balance for the stub shaft.

9. A stub shaft as claimed in claim 1 wherein the balance mass is moveable when the failure mass is displaced upon failure of the shaft in order that the balance mass engages by interference a brake or stable structure to facilitate limitation of the rotational speed of the stub shaft.

10. A turbine engine incorporating a stub shaft as claimed in claim 1.

* * * * *